United States Patent [19]

Sano et al.

[11] Patent Number: 4,839,033

[45] Date of Patent: Jun. 13, 1989

[54] APPARATUS FOR SEPARATING SPHERICAL FROM NON-SPHERICAL PARTICLES

[75] Inventors: Shigeru Sano, Ichinoseki; Saburo Yashima, Sendai, both of Japan

[73] Assignee: Ichinoseki National College of Technology, Ichinoseki, Japan

[21] Appl. No.: 198,498

[22] Filed: May 25, 1988

[30] Foreign Application Priority Data

Aug. 7, 1987 [JP] Japan ..... 62-196449

[51] Int. Cl.[4] ..... B07B 13/00; B07C 9/00

[52] U.S. Cl. ..... 209/4; 209/11; 209/45; 209/700; 209/931; 209/940

[58] Field of Search ..... 209/3, 3.1, 4, 11, 45, 209/46, 509, 606, 637, 689, 699, 700, 707, 910, 931, 940

[56] References Cited

U.S. PATENT DOCUMENTS

| | | | |
|---|---|---|---|
| 1,318,003 | 10/1919 | Wheeler et al. | 209/689 X |
| 3,672,500 | 6/1972 | Hayes | 209/931 X |
| 4,141,450 | 2/1979 | Clin et al. | 209/3.1 |
| 4,462,496 | 7/1984 | Stafford | 209/700 X |

FOREIGN PATENT DOCUMENTS

| | | | |
|---|---|---|---|
| 54-10585 | 5/1979 | Japan | 209/3.1 |
| 0597415 | 2/1978 | U.S.S.R. | 209/11 |
| 0735330 | 5/1980 | U.S.S.R. | 209/940 |
| 1033237 | 8/1983 | U.S.S.R. | 209/700 |
| 1321489 | 7/1987 | U.S.S.R. | 209/707 |
| 0579014 | 7/1946 | United Kingdom | 209/45 |
| 1224614 | 3/1971 | United Kingdom | 209/700 |

*Primary Examiner*—Johnny D. Cherry
*Assistant Examiner*—Edward M. Wacyra
*Attorney, Agent, or Firm*—Spencer & Frank

[57] ABSTRACT

An apparatus for separating particles in accordance with the sphericity of the particles is disclosed. The apparatus includes a housing which is supplied with air having a desired humidity, and which accommodates therein a cylindrical rotor with a horizontal shaft. The particles are charged into the housing from a hopper above the rotor, and tend to adhere onto the peripheral surface of the rotor with adhesive force which is dependent on the sphericity of each particle. The rotor is placed into a slow rotation and subjected to vibration whereby non-spherical particles and spherical particles are collected in respective receptacles arranged on both sides of the rotor shaft.

3 Claims, 5 Drawing Sheets

APPARATUS FOR SEPARATING SPHERICAL FROM NON-SPHERICAL PARTICLES

BACKGROUND OF THE INVENTION

1. Field of the Invention

The present invention relates to an apparatus for separating fine particles with the particle size typically on the order of 50~100 μm.

2. Description of the Related Art

In industries which involve handling of powder, advanced technology for separating particles in accordance with particle diameter makes it possible to separate particles with a micron order diameter. And, influences of the particle shape to the physical properties of the particles have come to be taken into consideration, along with the development of the ceramics industry, and as a result of commercial needs for more fine metal powder in the powder metallurgical industry.

Actually, when preparing shaped bodies of ceramic or metal powder, the particle shape exerts a substantial influence to the strength of the shaped body. On the other hand, during the process of manufacturing spherical particles, it is almost impossible to achieve a perfect spherical configuration. In view of the above, it became necessary to separate particles into spherical particles and non-spherical particles. There have been various proposals concerning methods for separating particles in accordance with the particle shape. However, known methods only permitted separation of particles with the diameter of no less than 0.5 mm, since these methods are generally based on principle whereby particles are separated into spherical particles and non-spherical particles by utilizing difference in rolling or sliding characteristics which exists between spherical and non-spherical particles. Thus, with the above-mentioned known technology, it is difficult to separate particles with the diameter of less than 0.5 mm.

SUMMARY OF THE INVENTION

The present invention has for its object to provide an apparatus which is based on a novel principle, and which is capable of separating particles with the diameter 100 μm or less. As a result of thorough investigations conducted by the inventors, it has been revealed that there is a difference in the adhesive force between spherical and non-spherical particles.

The present invention thus provides an apparatus for separating particles, which comprises a housing with a top wall, a hopper arranged on the top wall of said housing, for storing mixed particles and for supplying the mixed particles into inside of the housing, a rotatable cylindrical rotor with a horizontal shaft, arranged within the housing and below the hopper, a frame mounted on dampers and rotatably supporting said cylindrical rotor thereon, a pair of receptacles arranged on both sides of said shaft of the cylindrical rotor, one for receiving separated non-spherical particles, and the other for receiving separated spherical particles, a drive motor coupled with said shaft for driving said cylindrical rotor, a vibrator for subjecting the frame to a vertical vibration, and an inlet for supplying into said housing air with a desired humidity, said inlet being arranged close to said hopper.

DETAILED EXPLANATION OF THE PREFERRED EMBODIMENT

The present invention will now be explained in further detail, by referring to the accompanying drawings.

Figure 1A:
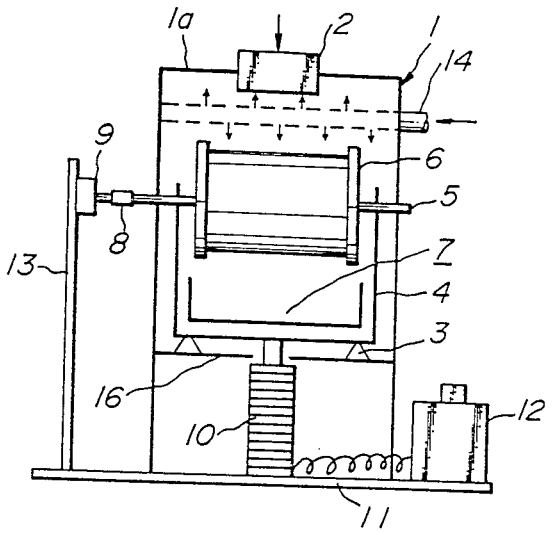
FIGS. 1A and 1B are schematic sectional views of the apparatus according to one embodiment of the present invention.
Figure 1B:
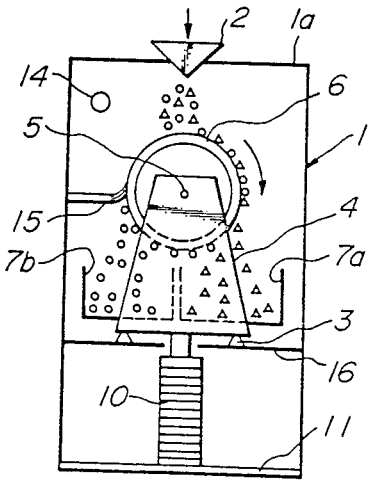

To begin with, FIGS. 1A and 1B are sectional views showing one embodiment of the apparatus according to the present invention. The apparatus includes a housing 1 with a top wall 1*a*, defining a closed chamber therein, a hopper 2 arranged provided on the top wall 1*a* of the housing 1 for storing mixed particles and for supplying the particles into the chamber of the housing 1. Arranged within the housing 1 are a plurality of dampers 3 made of rubber or other suitable material for an effective suppression of vibration. These dampers 3 serve to support a frame 4 which, in turn, rotatably supports a cylindrical rotor 6 with a horizontal shaft 5 journaled by bearings (not shown) in the frame 4. Preferably, the cylindrical rotor 6 has an outer peripheral portion which is composed of glass. The apparatus further includes a first receptacle 7*a* for collecting non-spherical particles, which is arranged on the front side of the shaft 5, and a second receptacle 7*b* for collecting spherical particles, which is arranged on the rear side of the shaft 5. An elastic coupling 8 serves to couple the shaft 5 with a drive motor 9 for the cylindrical rotor 6. An electromagnetic vibrator 10 is mounted on a base plate 11, and is connected to the bottom portion of the frame 4 for subjecting the frame 4 to a vertical vibration. For controlling the intensity, i.e. the amplitude and/or frequency, of the vibration generated by the electromagnetic vibrator 10, a voltage regulator 12 is connected to the vibrator 10. Further mounted on the base plate 11 is a support bracket 13 by which the drive motor 9 is supported. There is provided an inlet tube 14 for supplying into the chamber within the housing 1 fresh air with a desired added humidity, which tube 14 is arranged in the upper portion of the housing 1 close to the hopper 2. Further arranged within the housing 1 is a scraping brush 15, the function of which will be explained hereinafter, and a stand 16 for mounting the frame 14 thereon.

The principle and function of the apparatus with the above-mentioned structure will be explained below. In the present invention, spherical and non-spherical particles of powder are separated from each other, according to the shape or sphericity of particles, making use of the difference in the adhesive force with which particles remain adhered to the cylindrical rotor 6.

As a result of the thorough investigations conducted by the inventors, under condition in which the humidity is maintained constant, the adhesive force of the particle becomes stronger as the particle shape approaches a perfect sphere. Particularly, with an increased humidity of the atmosphere, a remarkable difference can be observed between the adhesive force of spherical particles and that of non-spherical particles. This can be clearly recognized from FIG. 2 which is a graph showing the relationship between the adhesive force of glass particles and relative humidity.

Figure 2:
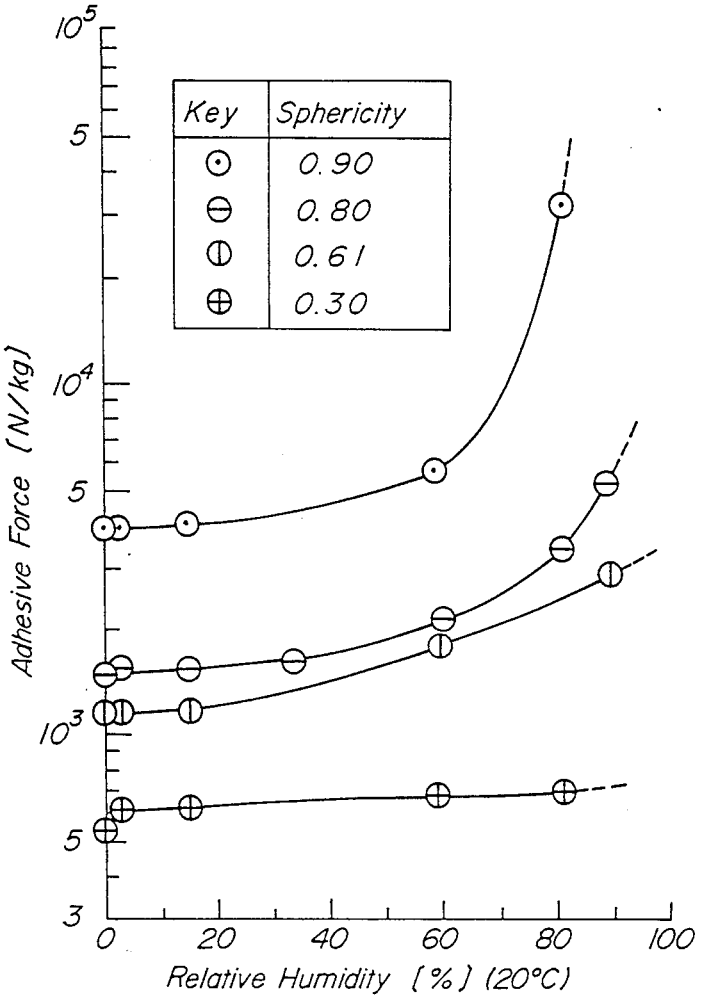
FIG. 2 is a graph showing the relationship between the relative humidity, and the adhesive force with which 50% or more of glass particles with various shapes are held adhered onto the cylinder.

The abscissa in FIG. 2 represents the relative humidity, while the ordinate represents the adhesive force per unit mass of the glass particles. It is apparent from the graph that the adhesive force becomes higher in response to an increase in the relative humidity. Moreover, apart from the change in the relative humidity, the difference can be clearly recognized between the adhesive force of spherical particles with a sphericity of substantially 1 and that of the non-spherical particles with a sphericity far smaller than 1.

When separating particles by using the apparatus according to the illustrated embodiment of the present invention, the humidity of the atmosphere around the adhesive surface, to which particles are to be adhered, plays the most important role; hence it is necessary and important to clean up the adhesive surface, i.e. the outer peripheral surface of the cylindrical rotor 6, when actually operating the apparatus. As appreciated from FIG. 2, adhesive force of spherical particles, with which they remain adhered onto the adhesive surface of the cylindrical rotor 6, undergoes an abrupt and significant change under the humidity within the range of 60~70%. In contrast thereto, even in the same range of the humidity, the adhesive force of non-spherical particles does not exhibit a significant change. It can thus be concluded that the humidity range of 60~70% or more, may be fully utilized to maximize the difference in the adhesive force and to thereby permit an efficient separation in accordance with the sphericity.

In order to ascertain the most suitable humidity range for effectively and efficiently separating particles, the inventors conducted experiments under different humidity conditions, and with respect to three kinds of mixed particles as samples. The particle size was 150~170 meshes for the first sample, 170~200 meshes for the second sample, and 200~270 meshes for the third sample. The apparatus used here was of a basic structure having a configuration as shown in FIGS. 1A and 1B, of which the cylindrical rotor 6 of 150ϕ×120 (mm) was driven by the motor 9 slowly, e.g. at 4 rpm. At the same time, the electromagnetic vibrator was actuated to generate a vertical vibration which was transmitted to the cylinder 6 through the frame 4. The dampers 3 arranged at the bottom of the frame 4 serve to suppress generation of noises by the vibrator 10 and transmission of vibrating force to the housing 1.

Mixture particles composed of spherical particles and non-spherical particles were supplied from the hopper 2 into the housing 1, and were then caused to adhere onto the outer peripheral surface of the rotating cylinder 6 below the hopper 7. As the cylinder 6, rotating slowly at the speed of 4 rpm., completed a half turn of rotation, most of the non-spherical particles with poor adhesive force were subjected to separation from the surface of the cylindrical rotor 6 by the vibration, and were thus received by the receptacle **7*a* on the front side of the shaft 5. On the other hand, even after the rotation of the cylinder 6 in excess of a half turn, the spherical particles with a sufficient adhesive force were maintained adhered to the surface of the cylindrical rotor 6. It is for this reason that, the scraping brush 15 is arranged so a to be brought into contact with the surface of the cylinder 6, thereby to scrape the spherical particles off the cylinder 6, and recover the particles in the receptacle 7*b* on the rear side of the shaft 5, as shown in FIG. 1B. The chamber within the housing 1 was maintained at a controlled temperature of about 20° C. and at a controlled, but variable humidity of about 30~70%. The electromagnetic vibrator was driven by electric power at a frequency of 50 Hz with its original voltage of 100 V being lowered by the voltage controller 12**. Table 1 shows the particulars of the three samples.

TABLE 1

| Mean diameter of classified particles (μm) (mesh) | Density (kg/m³) | | Actually measured mean mass $\bar{m}$ (μg) | Mean diameter of particle $\bar{d}$ (μm) | Mean diameter of particle $\bar{d}'$ (μm) | Mean mass $\bar{m}'$ (μg) | Sphericity ψ (−) |
|---|---|---|---|---|---|---|---|
| 96.5 | Spherical particle | 2.460 | 1.198 | 78.7 | 99.3 | 1.261 | 0.95 |
| (150~170) | Non-spherical particle | 2.180 | 0.858 | 73.3 | 145.8 | 3.536 | 0.24 |
| 81.0 | Spherical particle | 2.430 | 0.858 | 70.7 | 94.1 | 1.059 | 0.81 |
| (170~200) | Non-spherical particle | 2.160 | 0.418 | 57.8 | 129.0 | 2.430 | 0.17 |
| 63.5 | Spherical particle | 2.400 | 0.450 | 57.2 | 81.1 | 0.669 | 0.67 |
| (200~270) | Non-spherical particle | 2.160 | 0.252 | 48.9 | 111.8 | 1.582 | 0.16 |

$\bar{m}$: mean mass of one particle, obtained by accurately measuring the total weight of a given amount of particles with a direct reading balance, counting the number of all the particles with a particle counter, and dividing the total weight of the particles by the counted number of particles.
$\bar{d}$: mean diameter of a particle obtained from the mean mass $\bar{m}$ and density ρof particles assumed to be spherical.
$\bar{d}'$: mean diameter of a spherical volume corresponding to a circumscribed square.
$\bar{m}'$: diameter dependent apparent mass obtained from the mean diameter d' and the density ρ of particles assumed to be spherical.
$\psi = \bar{m}/\bar{m}'$ Further to the above, it is also necessary to assertion a suitable intensity of the vibration by which the particles can be effectively separated. To this end, the intensity of the vibration has been controlled by the voltage controller 12 such as to induce the vibration with the amplitude 0.35 mm, with a voltage source of 60 V, 50 Hz, which values proved to be very effective to efficiently separate the particles.

Figure 3:
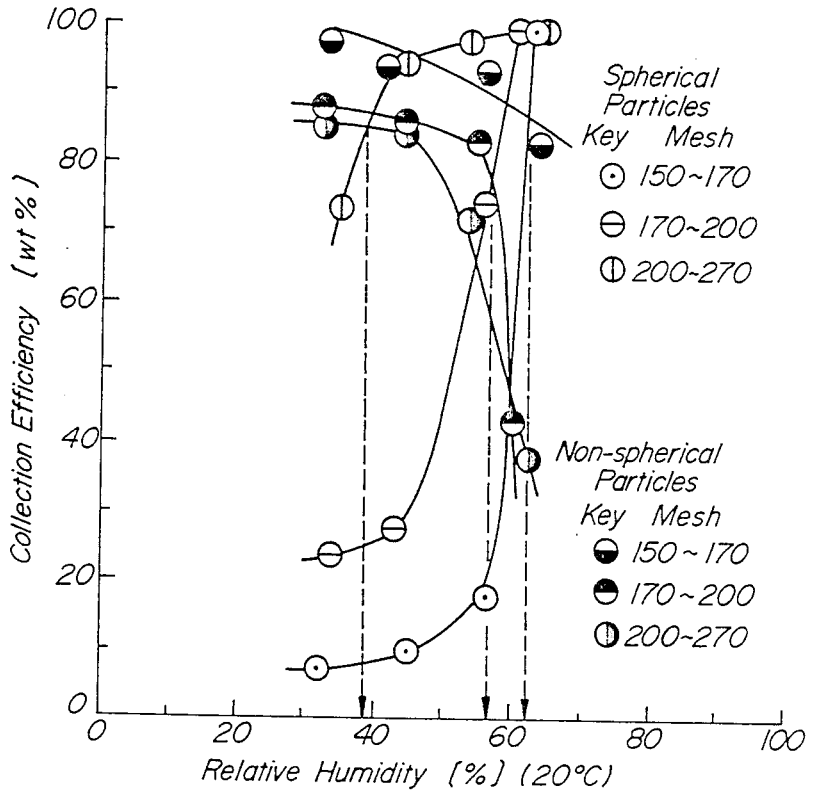
FIG. 3 is a graph showing the relationship between the relative humidity and the collection efficiency for spherical particles and non-spherical particles.

FIG. 3 is a graph showing the relationship between the collection efficiency for the spherical particles collected in the receptacle **7*b* and the humidity in the housing 1**, on one hand, and the relationship between the collection efficiency for the non-spherical particles collected in the receptacle 7*a* and the humidity in the housing 1, on the other hand. As particularly shown in FIG. 3, the collection efficiency for the spherical particles to be collected in the receptacle 7*b* becomes higher as the humidity in the housing 1 increases. In contrast thereto, the collection efficiency for the non-spherical particles to be collected in the receptacle 7*a* becomes lower and a greater amount of non-spherical particles are collected in the receptacle 7*b*, along with increase in the humidity. It can thus be concluded that the intersecting points of the curves representing the above-mentioned relationships correspond to the humidity with which the mixed particles can be most effectively separated. In other words, the optimum humidity to separate the mixed particles is 61.5% for the particle size of 150~170 meshes, 57% for the particle size of 170~200 meshes, and 38.5% for the particle size of 200~270 meshes.

Figure 4A:
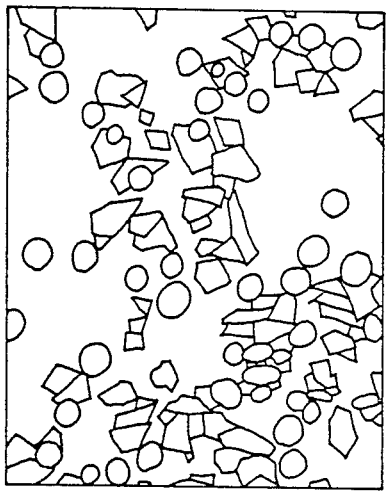
FIG. 4A is a sketch corresponding to microscopic photograph, and showing the particles collected in a receptacle for non-spherical particles.
Figure 4B:
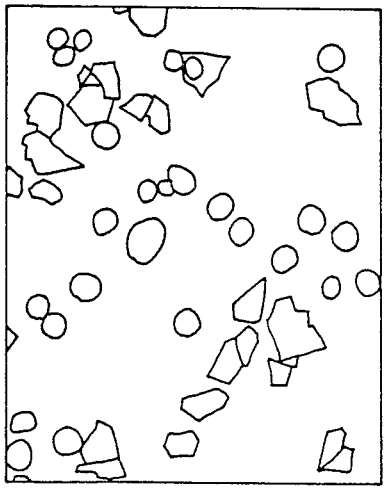
FIG. 4B is a similar sketch showing the particles collected in a receptacle for spherical particles.

To ascertain advantageous functions of the present invention, further experiments were conducted in the following manner. First of all, two sample groups I and II of mixed particles were prepared, the first group I having a weight of 20 grams obtained by mixing each 10 grams of spherical and non-spherical particles (weight ratio of 1:1), and the second group II having a weight of 8 grams obtained by mixing 6 grams of spherical particles and 2 grams of non-spherical particles (weight ratio of 3:1). These sample groups I and II were subjected to separation in accordance with the present invention, with the apparatus shown in FIGS. 1A and 1B. FIG. 4A is a sketch corresponding to a microscopic photograph, and shows the particles of the sample group I collected in the receptacle 7*a*, while FIG. 4B is a similar sketch and shows the particles of the same sample group I collected in the receptacle 7*b*. These sketches clearly reveal that a greater amount of spherical particles are collected in the receptacle 7*b*.

The following Table 2 shows all the experimental results. More particularly, Table 2 shows the relation between the particle diameter and the ratio of spherical particles among all the particles collected in the receptacle 7*b* for the spherical particles.

TABLE 2

| Mixture ratio (wt %) | Particle size (mesh) | Mean diameter of classified particles (μm) | Ratio of spherical particles collected in the receptacle 7b (wt %) |
|---|---|---|---|
| (spherical:non-spherical) | 150~170 | 96.5 | 74.4 |
| 1:1 | 170~200 | 81.0 | 69.5 |
| | 200~270 | 63.5 | 66.4 |
| (spherical:non-spherical) | 150~170 | 96.5 | 87.1 |
| 3:1 | 170~200 | 81.0 | 90.1 |
| | 200~270 | 63.5 | 87.4 |

In Table 2 above, the ratios of the spherical particles among all the particles collected in the receptacle 7*b* were obtained by calculation carried out in the following manner. First of all, by using microscopic photographs, the respective numbers of spherical and non-spherical particles, both collected in the receptacle 7*b*, were counted. The ratios were then obtained by multiplying the respective counted numbers by the average mass $\overline{m}$ per one particle measured actually, which has been referred to with respect to Table 1.

Figure 5:
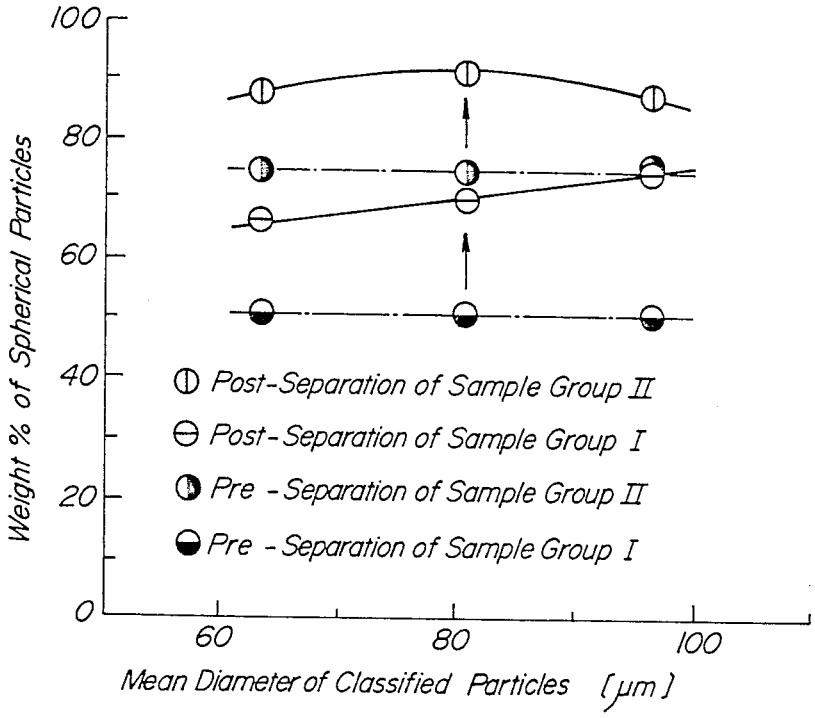
FIG. 5 is a graph showing the relationship between the mean diameter and the weight percent of the collected spherical particles, both before and after separation in accordance with the diameter.

FIG. 5 is a graph showing the relationship between the average diameter of classified particles, and the ratio (weight %) of spherical particles in the receptacle 7*b*. Here, the abscissa and the ordinate represent the average diameter and the ratio of spherical particles, respectively.

As to the mixture particles of the sample group II, the particle sample of 170~200 meshes, corresponding to 81.0 μm in the mean diameter of classified particles, exhibited the highest collection efficiency for the spherical particles, although the other two samples of the mixture particles of 150~170 meshes and 200~270 meshes could also be separated efficiently, to provide an improved collection efficiency for the spherical particles.

On the other hand, as to the mixture particles of the sample group I, a higher collection efficiency for the spherical particles could be achieved as the diameter of particles becomes larger. Thus, the mixture particles of 150~170 meshes (mean diameter of classified particles of 96.5 μm) could be separated with the highest efficiency.

It will be appreciated from the foregoing description that the apparatus of the present invention makes it possible to separate the mixture of spherical and non-spherical fine particles in accordance with the sphericity, by making use of the difference in the adhesive force as a result of difference in the surface tensions of atmospheric moisture around the particles. In case of glass particles, for example, it is possible to separate the particles with the diameter typically on the order of 50~100 μm.

When separating fine particles having the particle size of 200~270 meshes or more, application of a stronger vibration to the cylindrical rotor 6 makes it possible to achieve a higher collection efficiency for the spherical particles even under a constant humidity. Furthermore by maintaining a low humidity in the housing, an effective separation can be carried out with respect to smaller particles with the particle size on the order of 50 μm or less. Care has to be taken, however, to sufficiently remove the electrostatic field within the housing, which would otherwise result in an electrostatic aggregation of the particles whereby the desired separation might be impossible.

On the other hand, by precisely controlling application of the vibration to the cylindrical rotor, the principle of the present invention can also be applied to the separation of particles with a larger diameter, if necessary. In such a case also, an improved collection efficiency of spherical particles can be achieved by operating the apparatus under a higher humidity with which to provide a stronger adhesive force.

What is claimed is:

1. An apparatus for separating particles, comprising a housing with a top wall, a hopper arranged on the top wall of said housing, for storing mixed particles and for supplying the mixed particles into inside of the housing, a cylindrical rotor with a horizontal shaft, arranged within the housing and below the hopper, a frame mounted on dampers and rotatably supporting said cylindrical rotor thereon, a pair of receptacles arranged on both sides of said shaft of the cylindrical rotor, one for receiving separated non-spherical particles, and the other for receiving separated spherical particles, a drive motor coupled with said shaft for driving said cylindrical rotor, a vibrator for subjecting the frame to a vertical vibration, and an inlet for supplying into said housing air with a desired humidity, said inlet being arranged close to said hopper.

2. The apparatus as claimed in claim 1, wherein said cylindrical rotor has an outer peripheral portion which is composed of glass.

3. The apparatus as claimed in claim 1, further comprising a scraper brush which is arranged within the housing above said receptacle for receiving separated spherical particles, and which is adapted to be brought into contact with said cylindrical rotor to scrape spherical particles off said cylindrical rotor.

* * * * *